United States Patent [19]

Csaszar

[11] Patent Number: 4,907,708

[45] Date of Patent: Mar. 13, 1990

[54] DOUBLE BEAD TRACK CAP SYSTEM

[75] Inventor: Edward F. Csaszar, Mountainside, N.J.

[73] Assignee: General Kap Corporation, Bound Brook, N.J.

[21] Appl. No.: 295,971

[22] Filed: Jan. 11, 1989

[51] Int. Cl.[4] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 4,461,390 | 7/1984 | Csaszar | 215/252 |
| 4,567,993 | 2/1986 | Albrecht et al. | 215/252 |
| 4,669,623 | 6/1987 | Csaszar | 215/252 |

*Primary Examiner*—Donald F. Norton

*Attorney, Agent, or Firm*—Lerner, David, Littenberg, Krumholz & Mentlik

[57] ABSTRACT

Tamper-evident closures for application to containers are disclosed. The closures include a cylindrical side wall, a series of frangible bridges, and an annular skirt, and the skirt includes on its inner wall an upper raised portion, a lower raised portion, and an indented central portion therebetween. In this manner, an annular collar on the container can be locked between these upper and lower raised portions on the annular skirt portion of the closure, and this can result in improved consistent fracture of the frangible bridges upon removal of the closure from the container.

14 Claims, 8 Drawing Sheets

DOUBLE BEAD TRACK CAP SYSTEM

FIELD OF THE INVENTION

The present invention is directed to tamper-evident closures. More specifically, the present invention is directed to tamper-evident closures which have a frangible portion designed to fracture when the closure is removed from a container. This fracture makes it evident that the container has been tampered with or opened. Still more particularly, the present invention is directed to such containers including means for insuring that the fracture of the frangible portion of the closure is clean and highly reliable.

BACKGROUND OF THE INVENTION

Generally, tamper-evident bottle closures comprise a lower shoulder or skirt portion of the closure which is in some way intended to fracture or break upon dislocation (i.e., removal) of the closure on the container, so that it becomes evident that the container has been tampered with or opened. In the past, a large number of these closures have been produced, many on a commercial basis, on various containers including carbonated beverage bottles and other such containers maintained under significant pressures. Up until quite recently, metal closures predominated this field, such as those disclosed in U.S. Pat. No. 3,812,991. However, a series of prior inventions for alternative tamper-evident closures, such as set forth in U.S. Pat. No. 4,343,408, which are assigned to the assignee of the present application, have been quite successful in replacing such metal closures.

In this regard, these patents disclose several commercially significant improvements for such plastic closures for bottles and containers which are designed to include a tamper-evident feature. These inventions have been quite successful in capturing a significant share of the tamper-evident closure market. They have thus provided for the closure to be removed from the container cleanly and efficiently, obtaining a highly reliable fracture of the lower skirt portion. Furthermore, commercial closures have been provided thereby which can be applied in a simple, single step to a container or bottle.

A further improvement on these closures is set forth in U.S. Pat. No. 4,461,390, also assigned to the assignee of the present application. The improved devices disclosed therein include juxtaposed parallel intermediate side wall surfaces which assist in maintaining the upper and lower intermediate side wall portions in alignment with each other upon collapse of the frangible bridge means as the closures are applied to the containers. Thus, a more efficiently operating system is disclosed therein. Again, all of these closures have been and are highly successful.

In yet another such patent assigned to the assignee hereof, U.S. Pat. No. 4,479,586 relates to the inclusion of means for insuring that the portion of the closure which remains on the container after the closure has been removed now separates from the upper portion of the container so as to visibly reveal the fracture thereof. This is accomplished by including an inwardly directed non-locking tapered surface on the container itself which causes the depending lower skirt portion to move downwardly along the non-locking tapered surface away from the annular collar portion of the container when the closure fractures, thus providing visual evidence of either tampering or opening.

Most recently, a further improvement to tamper-evident closures is set forth in U.S. Pat. No. 4,669,623. This closure interacts with the container itself to provide an even more reliable tamper-evident closure. This is achieved by providing a container finish which includes cooperating raised portions which interact with a raised portion on the closure.

While these closures have thus provided commercial products which cannot only provide the tamper-evident function, but which can also visibly demonstrate same, the search has nonetheless continued for even greater improvements in these devices, and most particularly to provide a structure which is fool-proof in connection with highly repetitious operations, and which can at the same time be inexpensively manufactured. It must be recognized in this regard that in applying these closures to bottles or other containers many hundreds of thousands of applications are carried out. It is important, however, that in each case, clean and uniform application of the closure to the container take place, without prematurely fracturing the bridges on the closure, and in a manner such that when the closure is subsequently removed, these bridges will then cleanly and uniformly fracture with relative ease. A failure rate of even a few percent is not an acceptable result in many commercial settings, such as medicinal uses. Until now, reliability has been achieved as a result of manufacturing containers to exact specifications, with a very low tolerance for error. Specifically, bottles have had to be manufactured including an abruptly angled locking bead. The need for such modification in the bottles or containers themselves, however, necessarily results in a significant increase in the manufacturing costs of these tamper-evident containers.

SUMMARY OF THE INVENTION

In accordance with the present invention, it has now been discovered that an essentially fool-proof commercial closure can be produced by modifying the structure of the closure itself. This is a significant advance, as the container may now be more or less a "standard" container, and at the same time highly uniform and efficient closure application can be obtained. In particular, applicant has now discovered that these objects may be accomplished by providing a tamper-evident closure for application to a container body which includes an radially projecting annular collar having a predetermined longitudinal length at a predetermined axial location thereon. This closure has a one-piece closure body which has a horizontal end wall and a cylindrical side wall. The cylindrical side wall includes an upper portion, an annular lower skirt portion, and an intermediate side wall portion therebetween. The intermediate side wall portion of the closure includes a frangible portion comprising an area of weakness designed to fracture when the closure is dislocated and thereby provide evidence of such closure dislocation. The annular lower skirt portion includes an inner surface defining a radially protruding upper raised portion, a radially protruding lower raised portion, and a radially indented central depressed portion therebetween. The central depressed portion has a diameter which is greater than the diameter of both the upper and lower raised portions, and has a length which substantially corresponds to the predetermined longitudinal length of the outwardly projecting annular collar on the container body, at the predetermined axial location thereof. In this manner, the radially projecting annular collar can be locked between the upper raised portion and the lower raised portion of the closure causing fracture of the frangible portion of the closure upon removal of the closure from the container body.

In accordance with one embodiment of the tamper-evident closure of the present invention, the diameter of the central depressed portion, prior to application of the closure to the container body is less than the axial diameter of the radially projecting annular collar.

In accordance with another embodiment of the tamper-evident closures of the present invention, the cylindrical side wall of the closure has a length which is greater than the distance between the open end of the container body and the radially projecting annular collar, so that when the closure has been fully applied to the container body, the annular lower skirt portion of the closure is disposed below the radially projecting annular collar.

In accordance with another embodiment of the tamper-evident closure of the present invention, the radially protruding upper raised portion has a first diameter, and the radially protruding lower raised portion has a second axial diameter, the first diameter being greater than the second diameter so that the radially projecting upper raised portion protrudes inwardly from the inner surface of the annular lower skirt portion a lesser distance than the radially projecting lower raised portion.

In accordance with another embodiment of the tamper-evident closure of the present invention, the radially protruding lower raised portion includes an upper surface and a lower surface, the upper surface having a relatively steep angular face and the lower surface having a relatively gradual angular face, so that the radially protruding lower raised portion can readily pass over the radially projecting annular collar upon application of the closure to the container body but cannot pass over the radially projecting annular collar upon removal of the closure from the container body without fracturing the frangible means.

In a preferred embodiment the relatively steep angle of face is at an angle of between about 50° and 70° with respect to the vertical, and the relatively gradual angular face is at an angle of between about 30° and 45° with respect to the vertical.

In accordance with another embodiment of the tamper-evident closure of the present invention, the frangible portion divides the intermediate side wall portion into an upper intermediate side wall portion and a lower intermediate side wall portion above and below the frangible portion, respectively, the frangible portion comprising bridge means located circumferentially around the closure, the bridge means being sufficiently thin and flexible so as to be capable of collapsing when the depending lower skirt portion passes over the annular collar portion of the container as the closure is being applied to the container, thereby permitting the upper and lower intermediate side wall portions to abut against each other thus permitting the closure to be applied to the container without prematurely fracturing the bridge means.

In accordance with another embodiment of the tamper-evident closure of the present invention, the depending lower skirt portion of the annular collar has a predetermined length, that length being such that upon complete application of the closure to the container body the annular collar is locked between the upper raised portion and the lower raised portion of the closure.

In accordance with another embodiment of the tamper-evident closure of the present invention, the container includes a neck portion which comprises a threaded neck portion, and the upper portion of the cylindrical side wall of the closure comprises an internally threaded upper portion.

In accordance with another embodiment of the tamper-evident closure of the present invention, the upper and lower intermediate side wall portions are in substantial alignment with each other in the plane of the cylindrical side wall.

In accordance with another embodiment of the tamper-evident closure of the present invention, at least a portion of the upper and lower intermediate side wall portions include juxtaposed, parallel surfaces to provide surfaces for abutment of the upper and lower side wall portions upon collapse of the bridge means. Preferably, the lower intermediate side wall portion includes a plurality of stabilizer members.

In accordance with another embodiment of the tamper-evident closure of the present invention, the bridge means comprises a plurality of bridge members located circumferentially around the closure. Preferably eight of these bridge members are located equidistantly about the closure.

BRIEF DESCRIPTION OF THE DRAWINGS

The tamper-evident closure of the present invention can be further understood with reference to the drawings herein wherein.

DETAILED DESCRIPTION

Figure 1:
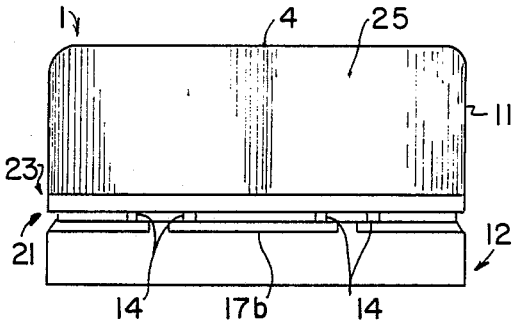
FIG. 1 is a side, elevational view of one embodiment of the tamper-evident closure of the present invention.
Figure 2:
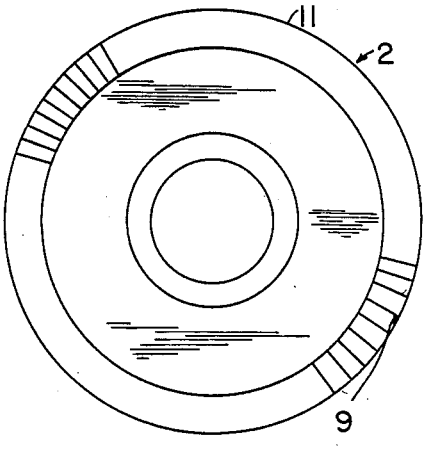
FIG. 2 is a top, elevational view of the closure of FIG. 1.
Figure 4:
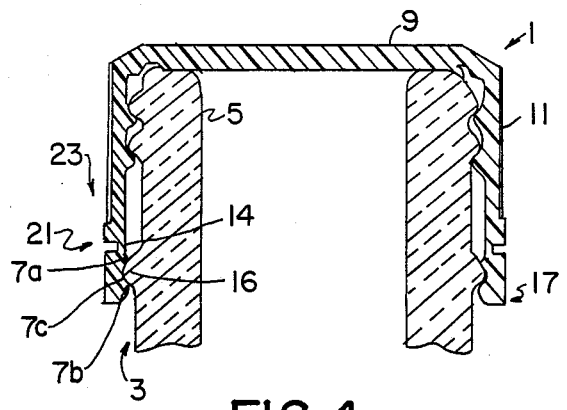
FIG. 4 is a side, cross-sectional, elevational view of the tamper-evident closure of FIG. 1 applied to a container.

Referring specifically to the figures, in which like numerals refer to like portions thereof, FIG. 1 shows a tamper-evident closure 1 of the present invention. In FIG. 4 the closure 1, which is preferably manufactured from a thermoplastic material, is completely threaded onto a bottle or container body 3. In this case, the bottle itself includes a threaded neck portion 5 and a radially projecting annular collar 16 therebelow. In some instances, this annular collar 16 can constitute what has in the past been referred to as a transfer bead, which has that name because it has been formed in connection with the manufacture of certain types of bottles (generally glass bottles) in order to assist in the transfer or movement of the bottles during their formation. In any event, in accordance with the present invention, it is now possible to avoid the need to custom make this annular collar portion 16, but in most instances it will now be possible to utilize such collar portions as are already being employed thereon, such as transfer beads, for example, or to use an annular collar portion 16 without the need to be concerned over the precise tolerances thereof. The tamper-evident closures hereof can thus be custom designed to apply to the bottle or container finish of essentially any existing container.

Figure 6:
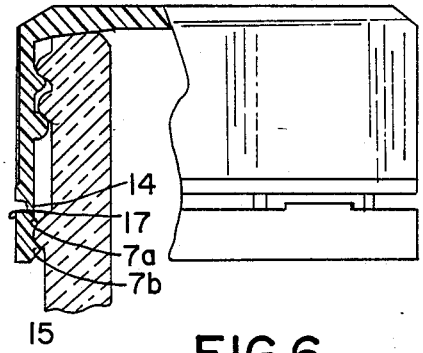
FIG. 6 is a side, elevational, partly cross-sectional view of a tamper-evident closure of FIG. 1 applied to a container.

As can best be seen in FIGS. 4 and 6, an area of weakness is located in the intermediate side wall portion 23 of the closure 1 above the depending lower skirt portion 12, but below the internally threaded upper portion 11. In particular, a groove 21 is located on the outer surface of the closure 1. Groove 21 completely severs the intermediate side wall portions of the closure except for the remaining bridge portion(s) 14 which thus connect the upper and lower intermediate side wall portions formed by groove 21, designated as portions 15 and 17 (see FIG. 3). The bridges are located circumferentially around the closure, as is shown in FIG. 1. These bridges thus connect the upper and lower intermediate side wall portions 15 and 17, and preferably have a thickness represented by the distance between the bottom of groove 21 and the inner wall of the closure, and generally being a distance of from about 0.003 to 0.015 inches, preferably from about 0.006 to 0.010 inches, and most preferably about 0.008 inches, e.g. from about 0.007 to 0.009 inches. These bridges 14 are thus sufficiently thin and flexible such that as the closure 1 is being applied to the container body, the upper surface 19 of the annular collar 16 comes into contact with the upper surface *7a'* of the upper raised portion *7a* of the closure or bead portion 7 of the closure, bridge portions 14 can temporarily collapse, and the upper and lower intermediate side wall portions 15 and 17 can come into direct abutment or contact with each other, as is discussed more fully below.

In the instant invention, as can be most clearly seen in FIGS. 4 through 7, the depending lower skirt portion 12 of the closure 1 includes a radially protruding upper raised portion *7a*, a radially protruding lower raised portion *7b*, and a radially indented central depressed area *7c* therebetween. (This overall structure is generally designated herein as dual bead 7 for ease of description.) The central depressed area *7c* can thus essentially form a "track" into which the annular collar 16 can be locked prior to fracture of the closure upon its removal from the container body.

A significant aspect of this invention relates to the particular commercial environment in which these closures are employed. In many cases it is desirable to apply the closures by means of high speed equipment which automatically applies the one-piece closures to the container bodies. This requires equipment which performs the turning procedure for application of the threaded closure to the threaded container body. However, in doing so a rather high torque can be applied to the closure, thereby increasing the chances for premature fracture of the bridges on the closure during initial closure application. In connection with the container bodies such as those shown in applicant's prior U.S. Pat. No. 4,461,390, this problem could be overcome by merely reducing the diameter of the inwardly projecting bead element analogous to the instant dual bead 7. However, while this could eliminate the problem of potential premature fracture, it can also result in an increased likelihood that the closure could be removed from the container without fracturing the closure. This, of course, frustrates the entire function of such tamper evident devices. In answer to this problem, U.S. Pat. No. 4,669,623 introduced a track system which overcame to a great degree these problems. Unfortunately, the apparatus of the '623 patent still requires a very specific container slope, i.e., the annular collar on the container had to be specifically designed for the closure in question. In the case of the present invention, this problem is solved by first increasing the diameter of the lower raised portion *7b*, as compared to the diameter of the annular collar 16, and by then adding the upper raised portion *7a* and the central depressed area *7c* therebetween. In this manner practically error-free closure application by means of automatic equipment can now be obtained, along with essentially complete fracture reliability upon later closure removal.

Figure 5:
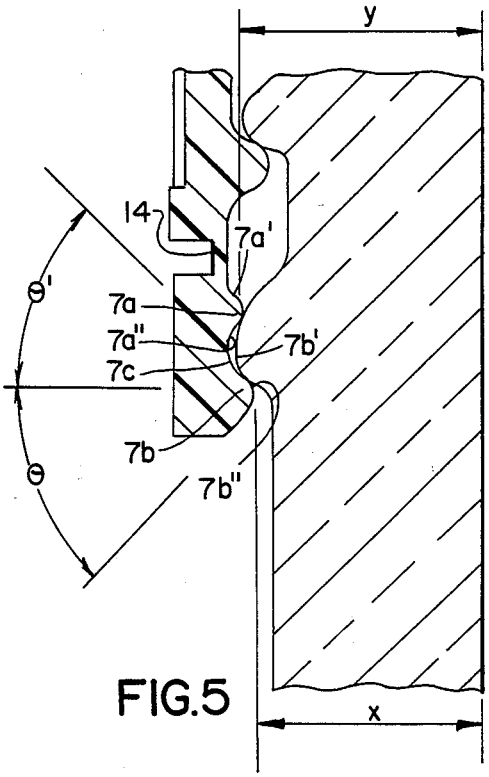
FIG. 5 is a side, elevational, enlarged, cross-sectional view of a portion of the tamper-evident closure of FIG. 1 in conjunction with the container to which it is applied.

To this end, as can best be seen in FIG. 5, the lower raised portion and upper raised portion preferably have particular sizes and shapes. Specifically, upper raised portion *7a* has a top surface *7a'* and a bottom surface *7a''*, with bottom surface *7a''* being at an angle with respect to the vertical (or the longitudinal direction along the container body itself) which is similar to that of the angle of top surface *7a'* with respect to the vertical. On the other hand, turning to the lower raised portion *7b* this portion has a top surface *7b'* and a bottom surface *7b''*. In this case the top surface *7b'* has a relatively steep angular face, and preferably is at an angle 0' of between about 30° and 45° with respect to the horizontal. On the other hand, the bottom surface *7b''* has a relatively gradual angular face, preferably being at an angle 0 of between about 45° and 70° with respect to the horizontal, and preferably at about 60° with respect to the horizontal. In this manner the radially protruding lower raised portion *7b* can readily pass over the radially protruding annular collar 16 when the closure is being applied to the container body, but on the other hand the radially protruding lower raised portion *7b* cannot pass over the radially protruding annular collar 16 upon removal of the closure from the container without fracturing the frangible means or bridges used therein.

Figure 7:
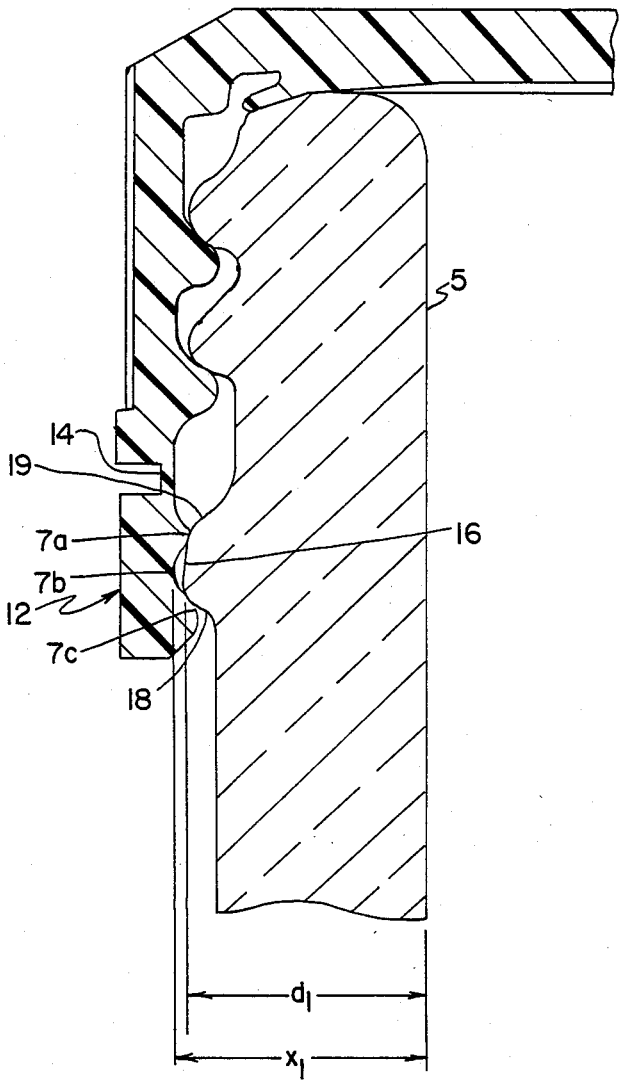
FIG. 7 is a side, elevational, enlarged, cross-sectional view of a portion of the tamper-evident closure of FIG. 1 in conjunction with the container to which it is applied.
Figure 8:
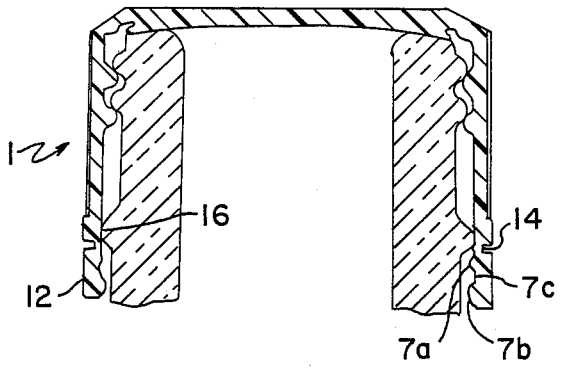
FIG. 8 is a side, elevational, cross-sectional view of another embodiment of the tamper-evident closure of the present invention, as applied to a container.

Referring once again to the annular collar 16 of the container body 3 which can best be seen in the embodiment of FIG. 7, annular collar 16 includes a lower surface 18 and an upper surface 19. The upper surface 19 of annular collar 16 preferably, but not necessarily, has a gradual inclined or tapered surface, so that as the closure is being threaded or other wise applied to the container and the surface 19 comes in contact with the lower surface *7b''* of lower raised portion *7b* of the inwardly projecting dual bead 7, the entire lower skirt portion 12 is gradually forced outwardly until the annular collar 16 snaps over the lower raised portion *7b*, and thus into the central depressed portion or "track" *7c*. The closure is thus completely applied to the container in the configuration shown in FIGS. 5 and 7. On the other hand, in the embodiment of the invention as shown in FIG. 8, where the depending lower skirt portion 12 has a significantly greater length, as the closure is further applied to the container body, the surface 19 will then come into contact with the lower surface *7a''* of the upper raised portion *7a* of the inwardly projecting bead 7, and the entire skirt portion 12 will then again be gradually forced outwardly until it snaps over this upper raised portion *7a*, and thus into the configuration shown in FIG. 8 therebelow.

The lower surface 18 of annular collar 16, which is preferably, but not necessarily, at an angle with respect to the horizontal which is less than that of the upper surface 19, can thus in such a preferred embodiment engage the corresponding upper surface *7a'* of the upper raised portion *7a* of the dual bead 7. However, in accordance with this invention, when the annular collar 16 is in the position in FIGS. 5, 7 and/or 11, it becomes "locked" between the upper raised portion *7a* and the lower raised portion *7b* of the dual bead 7. In this manner, gradual outward motion of the skirt portion 12 is prevented, and the reliable fracture of closure 1 is obtained in the manner discussed herein.

It is again noted, however, that the instant invention does not require that the annular collar 16 have the preferred structure discussed above, and thus the slopes on the upper and lower faces of the annular collar 16 are not critical, so long as their diameters are within acceptable ranges. What is far more critical is the shape of the lower raised portion *7b*, whose bottom surface *7b''* must generally have a gradual angle in order to provide reliable application, and whose upper surface *7b'* must have a relatively severe angle in order to provide reliable fracture and performance.

Referring again to FIG. 5, the dimension X shown therein represents the diameter of the lower raised portion *7b* of the dual bead 7. This dimension X will optimally be a dimension which both permits the closure to be applied to the container without fracturing the bridges and which at the same time can effect the fracture of the bridges upon removal thereof. If that precise, optimum diameter could be obtained in every case, there would in fact be no need for the improvements of the present invention. However, in actual practice this is generally not the case, and some variation from that optimum dimension must be taken into consideration. It is for that reason that 100% efficiency has not heretofore been obtainable, and therefore some of the closures have fractured upon application, and some of the closures have not fractured upon removal. In accordance with this invention, however, the dimension X of the diameter of the lower raised portion *7b* of the dual bead 7 of the closure can be somewhat greater than this optimum dimension X discussed above. By employing this diameter in connection with the lower raised portion *7b* of the present closure, it is now possible to apply this closure to the container body, and over the annular collar 16 without the risk of prematurely fracturing the bridge members. Furthermore, by providing upper raised portion *7a* and intermediate recessed "track" portion *7c* therebetween, the outwardly projecting annular collar 16 can be "locked" between these raised portions and within this recessed "track," and it becomes essentially impossible to remove the closure from the container body without fracturing the bridge means.

In a highly preferred embodiment the upper raised portion *7a* has a diameter Y as shown in FIG. 5 which is preferably greater than the diameter X of the lower raised portion *7b*. In other words, the overall size of the raised portion *7a* is less than the overall size of lower raised portion *7b*, the latter thus projecting a greater distance inwardly from the inner wall of the lower depending skirt portion 12 of the closures hereof. The reason is that it is the function of the upper raised portion *7a* to "lock" the annular collar portion 17 within the recessed portion *7c*, but upon further removal of the cap from the position shown in FIG. 5 fracture is essentially accomplished by means of the combination of this portion with the lower raised portion *7b*, and the size of upper raised portion *7a*, or the dimension of diameter Y is not as critical in this instance.

Figure 3:
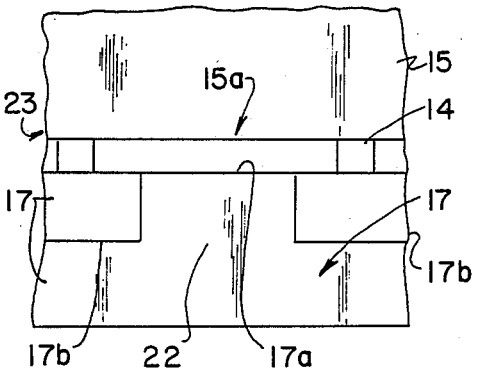
FIG. 3 is a partial, side, elevational view of a portion of the tamper-evident closure of FIG. 1.

Referring once again to the above discussion of the temporary collapse of bridge portions 14 upon application of these closures, the pressures created during such application of the closure are applied between these abutting surfaces, and are not entirely placed upon the bridge portions 14 themselves. This, in turn, in conjunction with the use of increased diameter X for the lower raised portion *7b*, prevents premature fracture of the bridges 14 upon closure application. In other words, as the depending lower skirt portion 12 (i.e., the dual bead 7), of the closure 1, and therefore the lower raised portion *7b* and/or the upper raised portion *7a*, pass over the annular collar 16 of the container, and the lower skirt portion 12 flexes outwardly, this flexing motion is not transferred directly to the bridge portions 14, which can now collapse, but is instead applied uniformly across the abutting upper and lower intermediate side wall surfaces 15 and 17. Additional means for dealing with these pressures in a more preferred manner are discussed below, but in any event this procedure, including collapse of the bridge portions 14, permits the depending lower skirt portion 12 to pass completely over the annular collar portion 7 of the container without fracturing bridge portions 14, which thus retain their original configuration, i.e, as shown in FIG. 3, with the upper and lower intermediate side wall portions now once again separated from each other and connected by bridge portions 14. In the particular embodiment shown in FIG. 3, the surface of the lower intermediate side wall portion 17 is formed at an angle shown as 17*b*. However, in such a case it is preferable to include in at least a portion of the lower intermediate side wall portion 17 stabilizer means 22. As can best be seen in FIGS. 1 and 3, stabilizer means 22, which can preferably include a plurality of stabilizer means located circumferentially around the closure, provide the lower intermediate side wall portion 17 with portions having a horizontal surface 17*a* which are juxtaposed with and parallel to the surfaces 15*a* of the upper intermediate side wall portion 15, both of which are now in the horizontal plane of the closure 1. These surfaces 15*a* and 17*a* thus come into contact with each other when the bridge portions 14 have collapsed, and the major portion of the pressures created by application of the closure 1 to the container are applied through these surfaces, and not through the bridge portions 14. In addition, however, the entire lower intermediate side wall portion 17 can also constitute a flat surface, i.e., one having the configuration of stabilizing means or tabs 22 (discussed in more detail below) all the way around the circumferences of the closure, in which case there will be no inclined portion 17*b* between separate tabs 22. Preferably, however, when the entire upper intermediate side wall portion 15 is a flat surface, as shown in FIG. 3, there will be four tabs 22 located on the lower intermediate side wall portion, and preferably they will be located at 90° intervals equidistantly around the circumference of the closure, so as to uniformly support the upper intermediate side wall surface upon collapse of the bridge members 14, as well as in order to facilitate the manufacturing process for the closure. Thus, these spaced tabs 22 will preferably be located between the spaced bridge members 14, preferably with two such spaced bridge members 14 between each of the spaced tabs 22. Again, such a configuration is quite helpful in reducing the pressures applied to the bridge members 14 and preventing any premature fracture thereof.

Figure 9:
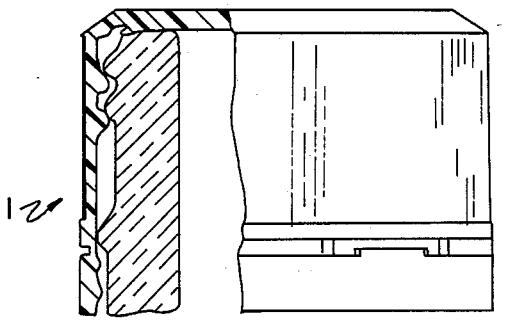
FIG. 9 is a side, elevational, partly cross-sectional view of the tamper-evident closure of FIG. 8 applied to a container.
Figure 10:
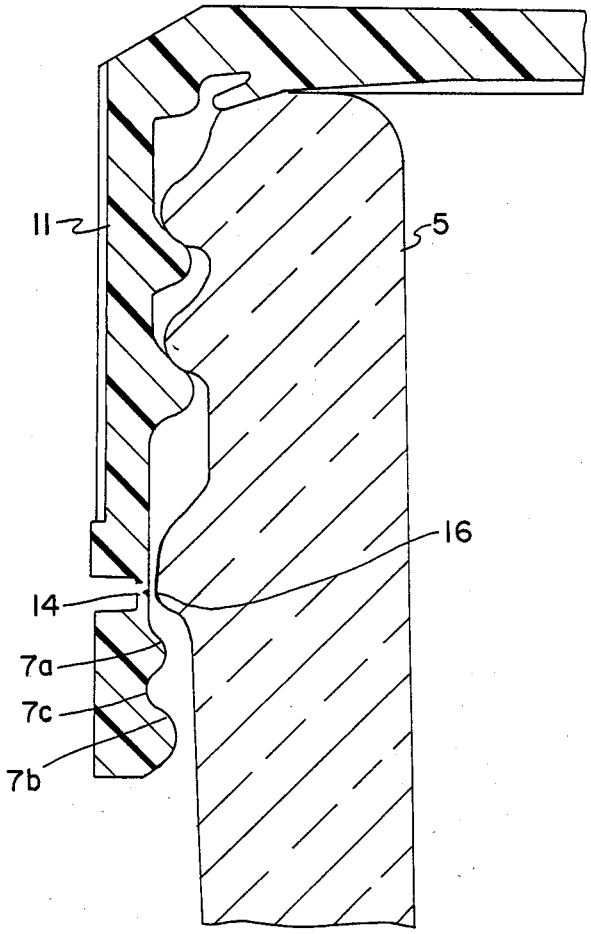
FIG. 10 is a side, elevational, enlarged, cross-sectional view of a portion of the tamper-evident closure of FIG. 8 upon application to a container.
Figure 11:
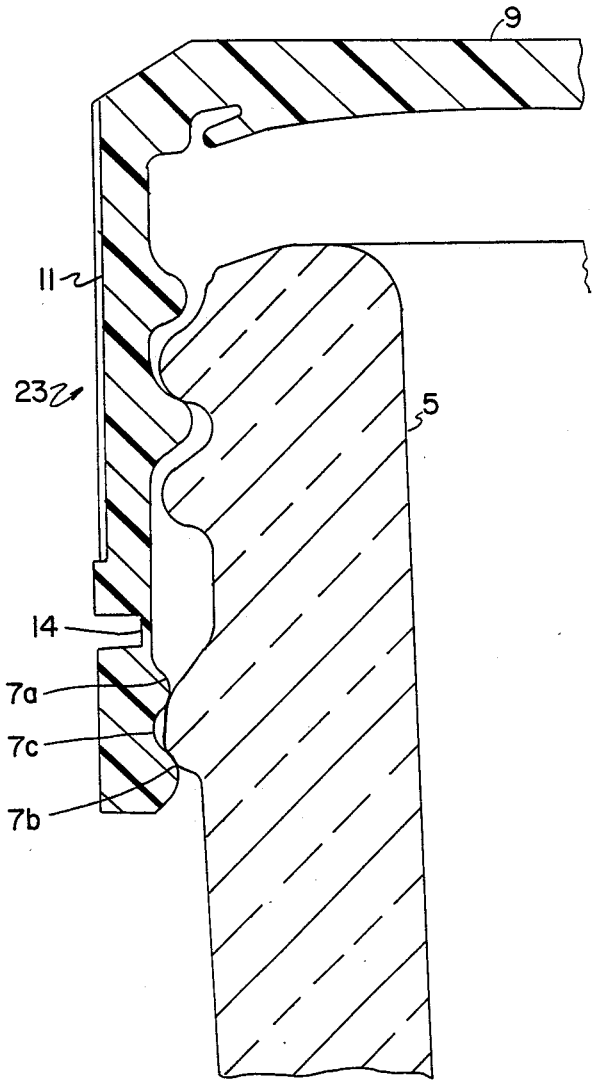
FIG. 11 is a side, elevational, enlarged cross-sectional view of a portion of the tamper-evident closure of FIG. 8, prior to fracture.
Figure 12:
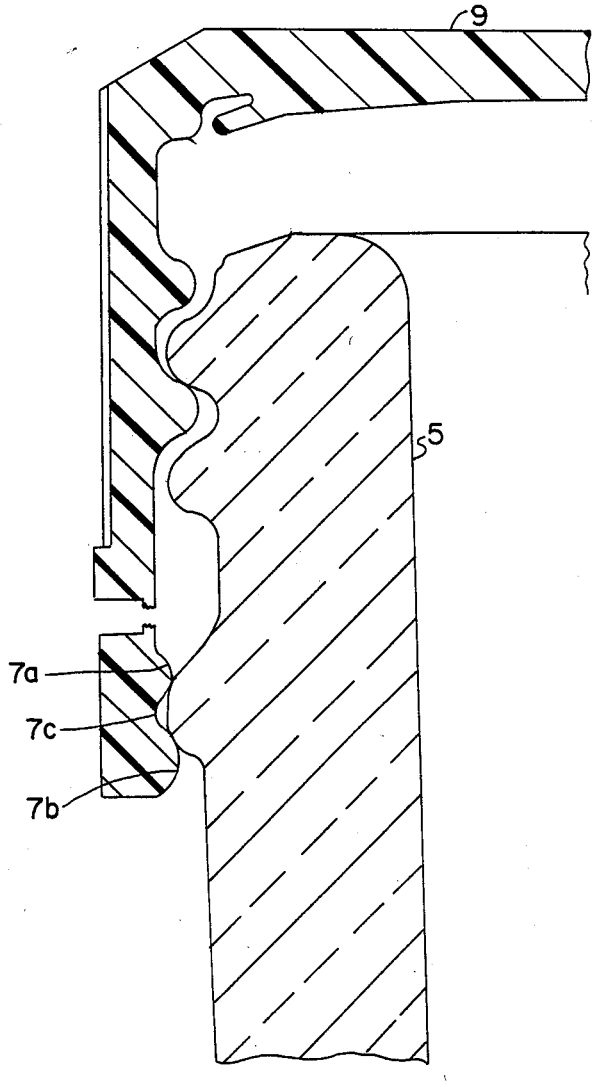
FIG. 12 is a side, elevational, enlarged, cross-sectional view of a portion of the tamper-evident closure of FIG. 8, during fracture.
Figure 13:
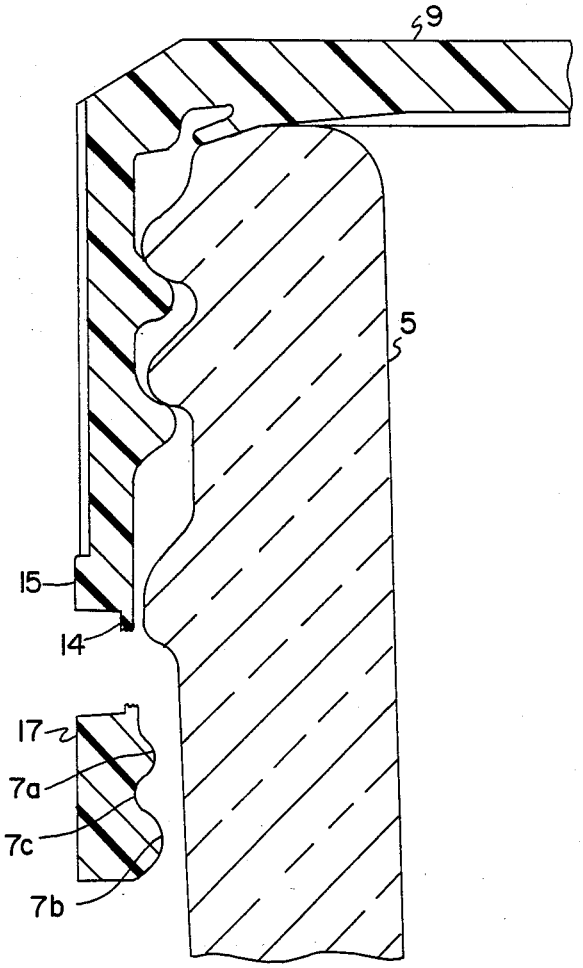
FIG. 13 is a side, elevational, enlarged, cross-sectional view of a portion of the tamper-evident closure of FIG. 8, subsequent to fracture and reapplication.

A preferred embodiment of this invention is shown in FIGS. 8 through 13. In this embodiment, the side wall of the closure has an elongated length which is long enough so that when the closure is completely applied, as shown in FIGS. 8 through 10, dual bead 7, including the upper raised portion 7*a*, will be located below the annular collar 16. Upon removal of the closure, the annular collar 16 will then pass over the upper raised portion 7*a* and into the "track" 7*c*, as can be seen in FIG. 11. Thus, at this stage of closure removal, the closure is in essentially the same configuration with respect to the outwardly projecting annular collar 16 as was so in connection with the embodiment shown in FIG. 7. Further removal of the closure from this point will then cause fracture of the bridges in much the same manner as was the case in connection with the embodiment shown in FIG. 7, again leaving the depending lower skirt portion 12 affixed to the annular collar portion 16 at the track 7*c* of the closure as shown in FIG. 12. This embodiment incorporates a number of novel features into the present invention. Most particularly, since subsequent to application of the closure itself to the container into the configuration shown in FIGS. 8–10 there is no interference fit, or in fact any contact between the dual bead 7 and the wall of the container 3, the closure retains it original configuration. That is, this can be compared and contrasted to the situation such as that shown in FIGS. 4–7, where upon application of the closure the annular collar 16 remains within the track 7 *c* between the upper and lower raised portions 7*a* and 7*b*. Because of the nature of the thermoplastic materials generally used for the closure the interference between the track 7*c* and the annular collar portion 16 will eventually cause the plastic material to "creep," that is, to begin to lose some of its memory and to move outwardly in light of the pressure applied thereto. This, in turn, can result in some inaccuracy in the ultimate removal of the closures. This can be fully eliminated, however, by means of the configuration shown in FIGS. 8 through 13 in which no such "creep" can occur since the annular collar portion 16 does not become locked within the track 7*c* until removal of the closure itself takes place.

Another advantage of the configuration shown in FIGS. 8 through 13 lies in the fact that upon removal of the closure into the configuration shown in FIG. 12, the upper end of the depending lower skirt portion 12 will project upwardly as shown therein. For this reason, and referring now to FIG. 13, when the upper portion of this closure is later screwed back onto the container body, the lower portion of the intermediate side wall will come into contact with the upper portion of the depending lower skirt portion 12 and drive it downwardly from the position shown in FIG. 12 to the position shown in FIG. 13, thus providing clear visual evidence of the fact that the container has either been tampered with or opened, i.e., there is a clear discernible distance between the upper and lower portions of the closure.

In addition, in another preferred embodiment, the extent to which the outwardly projecting annular collar 16 projects outwardly from the container, i.e., the distance $d_1$, as seen in FIG. 7, should be between about 0.020 and about 0.040 inches, and preferably about 0.030 inches. The distance $d_1$ is also significant in terms of its relationship to the diameter $x_1$ of the closure in the central depressed portion or track 7*c* between the upper and lower raised portions 7*a* and 7*b*, respectively. In particular, the diameter $x_1$ of the closure in this "track" area, or central depressed portion 7*c*, should be greater than the diameter of the annular collar 16 about its most outwardly projecting part. Further, it should be greater than the diameter of the upper and lower raised portions, 7*a* and 7*b*, and greater than the diameter of the prior container bodies immediately below their annular collar portions 7, since the annular 16 will now be locked between the upper and lower raised portions 7*a* and 7*b*.

In another embodiment, the stabilizing members, instead of being in the form shown in FIG. 3, are instead provided so that the upper surface 17*a* of the stabilizing members 22 are located above the point where the bridge members 14 are attached to the lower intermediate side wall portion 17. That is, the distance between the lower face 15*a* of the upper intermediate side wall portion 15 and the upper surface 17*a* of the stabilizing members 22 will be less than the overall length of the bridge members 14. In this manner, while the stabilizing members 22 still perform their function of accepting the pressures created during closure application and during collapse of the bridge members 14, in this case that collapse is not complete, or is only partial, since surfaces 15*a* and 17*a* will engage each other before the bridge members 14 have collapsed entirely, thus preventing any further such collapse, and further lessening the stresses applied to bridge members 14 during closure application. In addition, these types of stabilizers 22 also prevent the bridge members 14 from entirely collapsing during the molding of these closure and in much the same manner.

Referring again to FIGS. 1 and 4, groove 21 is formed in the outer wall of closure 1 in a manner such that when fracture occurs it occurs in a generally horizontal plane across the closure 1. Furthermore, and as can be seen in FIG. 12, such fracture occurs at a location above the lower depending skirt portion 12 such that the entire lower depending skirt portion 12 then remains (after fracture) engaged to the container body by nature of the upper raised portion 7*a* and the lower raised portion 7*b* of the dual bead 7, i.e., the internally threaded upper portion 11 has been completely removed from the container body. As can thus be seen, no part of the depending lower skirt portion 12 includes any weakened area therein.

Referring once again to FIG. 1, the outer surface of the internally threaded portion 11 can also include an area containing a plurality of vertical serrations 25 forming a roughened surface thereon. This surface has been found to be not only aesthetically appealing, but it also aides one in gripping the closure in order to twist it and thus fracture the bridges 14 and remove the internally threaded upper portion 11 therefrom.

As noted above, the closure 1 of the present invention is preferably made of a thermoplastic material, and can be manufactured in an injection molding process. Thus, the internal threads of the closure 1 can be formed by the action of an unscrewing mold. That is, after the part has been formed, during opening of the mold, the cores of the mold rotate and unscrew from the closure, thus forming the threads. The closure itself is kept from turning during this unscrewing phase by means of steel teeth, which engage in the bottom of the closure and hold it in place as the core rotates.

After the unscrewing cycle is complete, a stripper plate, which is part of the mold itself, ejects the finished closure from the mold. As the mold initially opens, and before the unscrewing cycle occurs, the closure is released from an undercut position in the mold by means of angle pins which cause cam bars to separate from around the closure. This undercut position was created because protruding portions of the mold (cams) were required in order to mold the annular groove, i.e., the weak portion of the closure is intended to fracture.

The relationship between the internal diameter of this protruding groove in the cams to the outside diameter of the mold core determines the thickness of the bridge portions 14. It is also thus possible to change that dimension in the closure by merely replacing these cam sections.

The closure can also be manufactured without using this unscrewing procedure by the stripper plate pushing the closure from the stationary core, in a process known as the stripping process.

Further, as an alternate to the cam action, the outside groove can be machined into a solid section of the closure as a secondary operation to the initial molding step. The remainder of the molding process is the same as in conventional thermoplastic molding processes.

The various embodiments of this invention also include various sealing means therein, such as a yieldable sealing disc which can be made of cork or other such commercial lining materials, and other such sealing means, all of which are also shown in issued U.S. Pat. No. 4,343,408, and are also incorporated therein by reference thereto.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

I claim:

1. A tamper-evident closure for application to a container body, said container body including an open end and having a radially projecting annular collar disposed proximate said open end, said annular collar having a predetermined longitudinal length at a predetermined axial position thereon, said closure comprising a one-piece closure body including a horizontal end wall and a cylindrical side wall, said cylindrical side wall including an upper portion, an annular lower skirt portion and an intermediate side wall portion therebetween.

said intermediate side wall portion including frangible means, said frangible means defining an area of weakness for providing evidence of closure dislocation by fracture thereof, said annular lower skirt portion including an inner surface, said inner surface defining a radially protruding upper raised portion, a radially protruding lower raised portion and a radial indented central depressed portion therebetween, said central depressed portion having a diameter which is greater than the diameter of said upper and lower raised portions and which is greater than the diameter of said annular collar portion of said container thereby providing a space therebetween, and said central depressed portion having a longitudinal length substantially corresponding to said predetermined longitudinal length of said annular collar at said predetermined axial position, whereby, said radially projecting annular collar can be locked between said upper raised portion and said lower raised portion within said central depressed portion creating a locked condition, said locked condition causing fracture of said frangible portion upon removal of said closure from said container body.

2. The tamper-evident closure of claim 1 wherein said diameter of said central depressed portion of said annular lower skirt portion, prior to application of said closure to said container body, is greater than the diameter of said radially projecting annular collar.

3. The tamper-evident closure of claim 1 wherein said cylindrical side wall of said closure has a length which is greater than the distance between said open end of said container body and said radially projecting annular collar, whereby when said closure has been fully applied to said container body said annular lower skirt portion of said closure is disposed below said radially projecting annular collar.

4. The tamper-evident closure of claim 1 wherein said radially protruding upper raised portion has a first diameter and said radially protruding lower raised portion has a second diameter, said first diameter being greater than said second diameter, whereby said radially projecting upper raised portion protrudes inwardly from said inner surface of said annular lower skirt portion a lesser distance than said radially protruding lower raised portion.

5. The tamper-evident closure of claim 1 wherein said radially protruding lower raised portion includes an upper surface and a lower surface, said upper surface having a relatively steep angular face and said lower surface having a relatively gradual angular face, whereby said radially protruding lower raised portion can readily pass over said radially projecting annular collar upon application of said closure to said container body but cannot be passed over said radially projecting annular collar upon removal of said closure from said container body without fracturing said frangible means.

6. The tamper-evident closure of claim 5 wherein said relatively steep angular face is at an angle of between about 30° and 45° with respect to the horizontal, and said relatively gradual angular face is at an angle of between about 45° and 70° with respect to the horizontal.

7. The tamper-evident closure of claim 1 wherein said frangible portion divides said intermediate side wall portion into an upper intermediate side wall portion and a lower intermediate side wall portion above and below said frangible portion, respectively, said frangible portion comprising bridge means located circumferentially around said closure, said bridge means being sufficiently thin and flexible so as to be capable of collapsing when said inwardly projecting bead passes over said upper raised portion of said annular collar portion of said container as said closure is being applied to said container to thereby permit said upper and lower intermediate side wall portions to abut against each other and thereby permit said closure to be applied to said container without fracturing said bridge means.

8. The tamper-evident closure of claim 7 wherein said upper and lower intermediate side wall portions are in substantial alignment with each other in the plane of said cylindrical side wall.

9. The tamper-evident closure of claim 7 wherein at least a portion of said upper and lower intermediate side wall portions include juxtaposed parallel surfaces for providing surfaces for abutment of said upper and lower side wall portions upon the collapse of said bridge means.

10. The tamper-evident closure of claim 9 wherein said lower intermediate side wall portion includes a plurality of stabilizer members.

11. The tamper-evident closure of claim 1 wherein said depending lower skirt portion of said closure has a predetermined length being such that upon complete application of said closure to said container body said annular collar portion of said container body is locked between said upper raised portion and said lower raised portion of said closure.

12. The tamper-evident closure of claim 1 wherein said neck portion of said container comprises a threaded neck portion, and said upper portion of said cylindrical side wall of said closure comprises an internally threaded upper portion.

13. The tamper-evident closure of claim 1 wherein said bridge means comprises a plurality of bridge members located circumferentially around said closure.

14. The tamper-evident closure of claim 13 including eight of said bridge members located equidistantly about said closure.

* * * * *

UNITED STATES PATENT AND TRADEMARK OFFICE

CERTIFICATE OF CORRECTION

PATENT NO. : 4,907,708

DATED : March 13, 1990

INVENTOR(S) : Edward F. Csaszar

It is certified that error appears in the above-identified patent and that said Letters Patent is hereby corrected as shown below:

Column 3, line 10, delete "axial".

Column 3, line 25, delete "axial".

Column 12, line 27, delete "central" and substitute therefor --centrally--.

Signed and Sealed this

Twenty-third Day of July, 1991

*Attest:*

*Attesting Officer*

HARRY F. MANBECK, JR.

*Commissioner of Patents and Trademarks*